US005479246A

United States Patent [19]

Suketomo

[11] Patent Number: 5,479,246

[45] Date of Patent: Dec. 26, 1995

[54] DEVELOPING DEVICE HAVING A PHOTOSENSITIVE ELEMENT CARRIER RECOVERY UNIT

[75] Inventor: Seiji Suketomo, Hyogo, Japan

[73] Assignee: Fujitsu Limited, Kawasaki, Japan

[21] Appl. No.: 260,951

[22] Filed: Jun. 16, 1994

[30] Foreign Application Priority Data

Sep. 21, 1993 [JP] Japan ..... 5-234903

[51] Int. Cl.[6] ..... G03G 15/09

[52] U.S. Cl. ..... 355/251; 118/652

[58] Field of Search ..... 355/245, 251, 355/253, 259, 298; 118/651, 652, 653, 656–658

[56] References Cited

U.S. PATENT DOCUMENTS 3,894,513 7/1975 Stanley et al. ..... 118/652

4,829,338 5/1989 Whittaker et al. ..... 118/652 X 5,280,323 1/1994 Alvarez et al. ..... 355/251

FOREIGN PATENT DOCUMENTS 63-163475 7/1988 Japan .

*Primary Examiner*—William J. Royer

*Attorney, Agent, or Firm*—Armstrong, Westerman, Hattori, McLeland & Naughton

[57] ABSTRACT

A developing device has a recovery unit having a recovery magnet and transport device. The recovery unit can stably hold carriers recovered from a photosensitive element, without dropping the carriers, and surely transport the carriers to a predetermined recovery position, thereby effectively eliminating drawbacks due to the adhesion of carriers to the photosensitive element.

17 Claims, 8 Drawing Sheets

DEVELOPING DEVICE HAVING A PHOTOSENSITIVE ELEMENT CARRIER RECOVERY UNIT

BACKGROUND OF THE INVENTION

Field of the Invention

The invention relates to a developing device that uses a two-component developer in which a toner is mixed with carriers made of a magnetic material, during a process of developing an electrostatic latent image formed on the surface of a photosensitive element.

Description of Related Art

In an electrophotographic device such as a copier, or a printer, an image is formed by the following steps: an exposure step of exposing the surface of a photosensitive element with light to form an electrostatic latent image corresponding to a desired image; a development step of causing a toner to adhere to the electrostatic latent image to develop the image; a transfer step of transferring the toner image obtained on the surface of the photosensitive element by the development step, to a predetermined transfer sheet; and a fixing step of giving heat to the transferred toner image to fix it. As the photosensitive element, generally, used is a cylindrical photosensitive drum which has a photosensitive layer on the outer peripheral face and which rotates about the axis. The exposure, development and transfer steps are respectively conducted by sequence in an exposure station, a development station, and a transfer station which are juxtaposed along the periphery of the photosensitive drum, as the photosensitive drum rotates.

In order to output a complex graphic image, recent electrophotographic devices are required to realize a high definition, and a high image quality. For example, fine lines must be reproduced, and a uniform solid portion must be realized. In order to meet these requirements, the adhesion density of a toner in the developing step must be increased, and hence a two-component developer is used in which the toner is mixed with carriers consisting of fine magnetic particles so that a large number of toner particles are held on the periphery of each carrier.

In a developing device using a developer of such a kind, a developing unit, and a recovery unit are juxtaposed along the periphery of a photosensitive drum along the rotational direction. The developing unit has a plurality of stationary magnets arranged along the peripheral direction of and inside an outer cylinder that is made of a non-magnetic material and that rotates about an axis parallel to the photosensitive drum. A part of the peripheral face of the outer cylinder is located in proximity to the surface of the photosensitive drum so as to oppose the surface, and the other part opposes a storage unit for the developer.

The toner in the developer is attracted together with the carriers to the outer cylinder of the developing unit by the magnetic force of the stationary magnets, and then transported along the peripheral direction as the outer cylinder rotates, while the attracting state is maintained by the function of a magnetic field along the peripheral direction which is generated by the plurality of stationary magnets. The toner and the carriers are combined with each other only by an electrostatic force which is generated by the mutual friction during the above-mentioned mixture process. In the portion where the outer cylinder opposes the photosensitive drum, therefore, the toner transported together with the carriers by the rotation of the outer cylinder is attracted to an electrostatic latent image formed on the outer surface of the photosensitive drum, and adheres to the latent image to develop it. On the other hand, the carriers and a part of the toner which remain on the outer cylinder are further transported by the rotation of the outer cylinder, and then separate from the outer surface of the outer cylinder to be recovered. This separation is conducted in an area which is not affected by the magnetic field and is formed in a part along the peripheral direction in accordance with the arrangement of the stationary magnets. The carriers and the part of the toner which have separated are mixed with fresh toner to be regenerated as a developer.

In such a development using a two-component developer, the developing unit transports the toner while a number of toner particles are held on the periphery of each carrier which has a form of a particle. Consequently, the toner adhesion density per unit area of an electrostatic latent image on the photosensitive drum can be increased so that the requirements for a high definition and a high image quality are satisfied. On the other hand, however, there is a possibility that a part of the carriers which are attracted to the developing unit to transport the toner may be separated from the developing unit by a centrifugal force due to the rotation of the outer cylinder, or as the toner moves to the photosensitive drum, and adhere together with the toner to the surface of the photosensitive drum. When the adhering carriers are left as they are, there arise the following inconveniences.

First, when the adhering carriers exist, a gap is formed between the photosensitive drum and a transfer sheet in the transfer station which is downstream of the development station, and a resulting partial image, due to a transfer failure, is produced; thereby impairing the image quality. Substances which remain to adhere to the surface of the photosensitive drum after the transfer process are removed by a sliding operation of a cleaning blade in a cleaner which precedes the exposure station. This removal operation is directed to a toner which is made of a resin. When adhering carriers exist, the carriers are caught up into the slidingly contacting portion between the cleaning blade and the photosensitive drum, thereby damaging both the blade and the drum. In succeeding copy processes, the impairment of the image quality due to the failure in cleaning, and that due to a scratch of the photosensitive drum constantly occur.

The recovery unit recovers carriers adhering to the surface of the photosensitive drum, before the carriers reach the transfer station, thereby eliminating the above-mentioned inconveniences. FIG. 1 is a diagram showing the configuration of a conventional recovery unit. In the figure, 1 designates a photosensitive drum, and 2 designates a developing unit. In the recovery unit 8, recovery and transport magnets 81 are stationarily disposed inside an outer cylinder 80 which is made of a non-magnetic material and which rotates in the opposite direction about an axis parallel to the photosensitive drum 1. The recovery unit 8 is disposed downstream of the developing unit 2 along the rotation direction of the photosensitive drum 1 in such a manner that a part of the peripheral surface of the outer cylinder 80 is in proximity to and opposes the surface of the photosensitive drum 1.

The recovery and transport magnets 81 consist of a magnet having one magnetic pole (e.g., N-pole) which is directed obliquely upward and faces the position where the recovery unit opposes the photosensitive drum 1, and another magnet having one magnetic pole (e.g., S-pole) which is directed downward and different from the polarity of the above-mentioned pole. A scraper 83 is disposed downstream of the recovery and transport magnets 81 along the rotational direction of the recovery unit 8, in such a manner that the front end of the scraper 83 slidingly contacts with the outer peripheral face of the outer cylinder 80. A recovery portion 84 is disposed under the slidingly contacting position.

When the recovery unit 8 is provided, the carriers C adhering to the surface of the photosensitive drum 1 in the vicinity of the developing unit 2 are attracted to the outer cylinder 80 by the magnetic force of the N-pole recovery and transport magnet 81, and then transported as the outer cylinder 80 rotates, while the attracting state is maintained by the function of a magnetic field which is generated by the recovery and transport magnets 81. The carriers C which are caused to reach the vicinity of the S-pole recovery and transport magnet 81 by this transportation are scraped by the scraper 83 from the surface of the outer cylinder 80 to drop downwards to be recovered in the recovery portion 84.

In the recovery unit 8 of the prior art which is configured as described above, however, the outer cylinder 80 incorporating the recovery and transport magnets 81 must have a large diameter. This produces a problem in that the size of the developing device itself is increased in order to obtain a space for disposing the recovery unit 8. Moreover the magnetic field which is generated by the recovery and transport magnets 81 is used as the means for holding the transported carriers C to the surface of the outer cylinder 80. Even when the magnetic force of the recovery and transport magnets 81 is enhanced, therefore, there is a limit in improvement of the holding ability. Consequently, there is a drawback that a part of the carriers C drop during the transportation and again adhere to the photosensitive drum 1 or to a transfer sheet tinder the process of being transported to the transfer station, thereby impairing the image quality. Moreover, since the scraper 83 for scraping off the carriers C stuck to the outer cylinder 80 always slidingly contacts with the peripheral face of the outer cylinder 80, in the slidingly contacting portion the scraper 83 and the outer cylinder 80 are inevitably damaged as the developing device is used, and hence there arises another such drawback as noises are generated as the slidingly contacting state is changed.

Japanese Application Laid-Open No. 63-163475 (1988) discloses a developing device having a recovery unit. In the recovery unit, a spiral groove is formed on the surface of an outer cylinder incorporating a recovery magnet at a position opposing a photosensitive drum, in such a manner that the spiral groove is caused to advance along the axial direction by the rotation of the outer cylinder, and elongates in one side of the length direction of the outer cylinder so as to be in excess of the length of the recovery magnet. In the developing device, carriers stuck to the outer cylinder by the magnetic force of the recovery magnet are caught in the spiral groove, and then transported along the axial direction by the spiral movement of the groove. When the carriers reach the elongated portion, the carriers are released from the magnetic force of the recovery magnet to be separated from the outer cylinder, and then recovered in the recovery portion which is disposed at this position.

According to this configuration, since it is required to dispose only the single magnet inside the outer cylinder, the recovery unit can be reduced in size, and a scraper for scraping off recovered carriers is unnecessary. However, carriers move while turning on the outer peripheral face as the outer cylinder rotates, until they are caught in the spiral groove. In the same manner as the conventional recovery unit shown in FIG. 1, the holding of the carriers during this period relies on the magnetic force of the recovery magnet. Consequently, the drawback that a part of the carriers drop and adhere to the photosensitive drum or a transfer sheet so that the image quality is impaired remains to be eliminated. In order to stably hold carriers after they are caught in the spiral groove, moreover, it is required to set the angle of inclination of the spiral groove to the axis of the outer cylinder to be small, or to set the pitch of the spiral groove to be large. This produces a drawback in a practical use that the formation of such a spiral groove requires a special working method or many working hours.

Summary of the Invention

The invention has been conducted in order to solve the above-discussed problems. It is an object of the invention to provide a developing device comprising a recovery unit which can stably hold carriers recovered from a photosensitive element, without a possibility of dropping the carriers, and surely transport the carriers to a predetermined recovery position, thereby effectively eliminating the drawbacks due to the adhesion of carriers to the photosensitive element.

The developing device of the invention comprises a developing unit for developing an electrostatic latent image formed on the surface of a photosensitive element with a developer containing carriers which are made of a magnetic material, and a recovery unit for recovering by the magnetic force carriers which adhere to the surface of the photosensitive element as a result of a development conducted by the developing unit, the developing unit and the recovery unit being in proximity to and opposing the surface of the photosensitive element, and being juxtaposed along a transportation direction of the photosensitive element, and is characterized in that the recovery unit includes, an outer cylinder which is made of a non-magnetic material, and which rotates about an axis which is substantially parallel to the surface of the photosensitive element, a recovery magnet which is disposed inside the outer cylinder, one magnetic pole of the recovery magnet being directed to the side opposing the photosensitive element, means for obstructing a magnetic field generated by the other magnetic pole of the recovery magnet, and transport means for transporting carriers caught on an outer peripheral face of the outer cylinder by a magnetic force of the one magnetic pole, along a peripheral direction in accordance with the rotation of the outer cylinder.

Furthermore, the developing device of the invention is characterized in that the transport means is a rugged face which is formed by a surface treatment in a substantially whole area of the outer peripheral face of the outer cylinder.

Therefore, carriers adhering to the surface of the photosensitive element are caused by the magnetic force of the recovery magnet to be stuck to a portion of the outer cylinder which opposes the photosensitive element, caught on, for example, the rugged face of the outer peripheral face, and then transported along the peripheral direction by the rotation of the outer cylinder against the magnetic force of the recovery magnet without dropping from the outer cylinder.

Furthermore, the developing device of the invention is characterized in that the outer cylinder is disposed at a position where the outer cylinder opposes the surface of the photosensitive element in an obliquely upward direction, and the rotation direction of the outer cylinder is set to be a direction in which the transport of carriers caught on and conducted by the transport means is directed downward, and the direction of the magnetic force of the recovery magnet substantially coincides with a line which perpendicularly crosses the surface of the photosensitive element. Therefore, carriers are caused to drop by gravity at an adequate rotational position, and then recovered.

Moreover, the developing device of the invention is characterized in that a gap between the outer peripheral face of the outer cylinder and the surface of the photosensitive element is set in accordance with the magnetic force of the recovery magnet. Therefore, carriers can surely be stuck to the outer cylinder.

Moreover, the developing device of the invention is characterized in that the magnetic force of the recovery magnet is set in accordance with a peripheral speed of the outer cylinder. Therefore, carriers can surely be transported by the rotation of the outer cylinder.

The above and further objects and features of the invention will more fully be apparent from the following detailed description with accompanying drawings.

DESCRIPTION OF THE PREFERRED EMBODIMENTS

Figure 2:
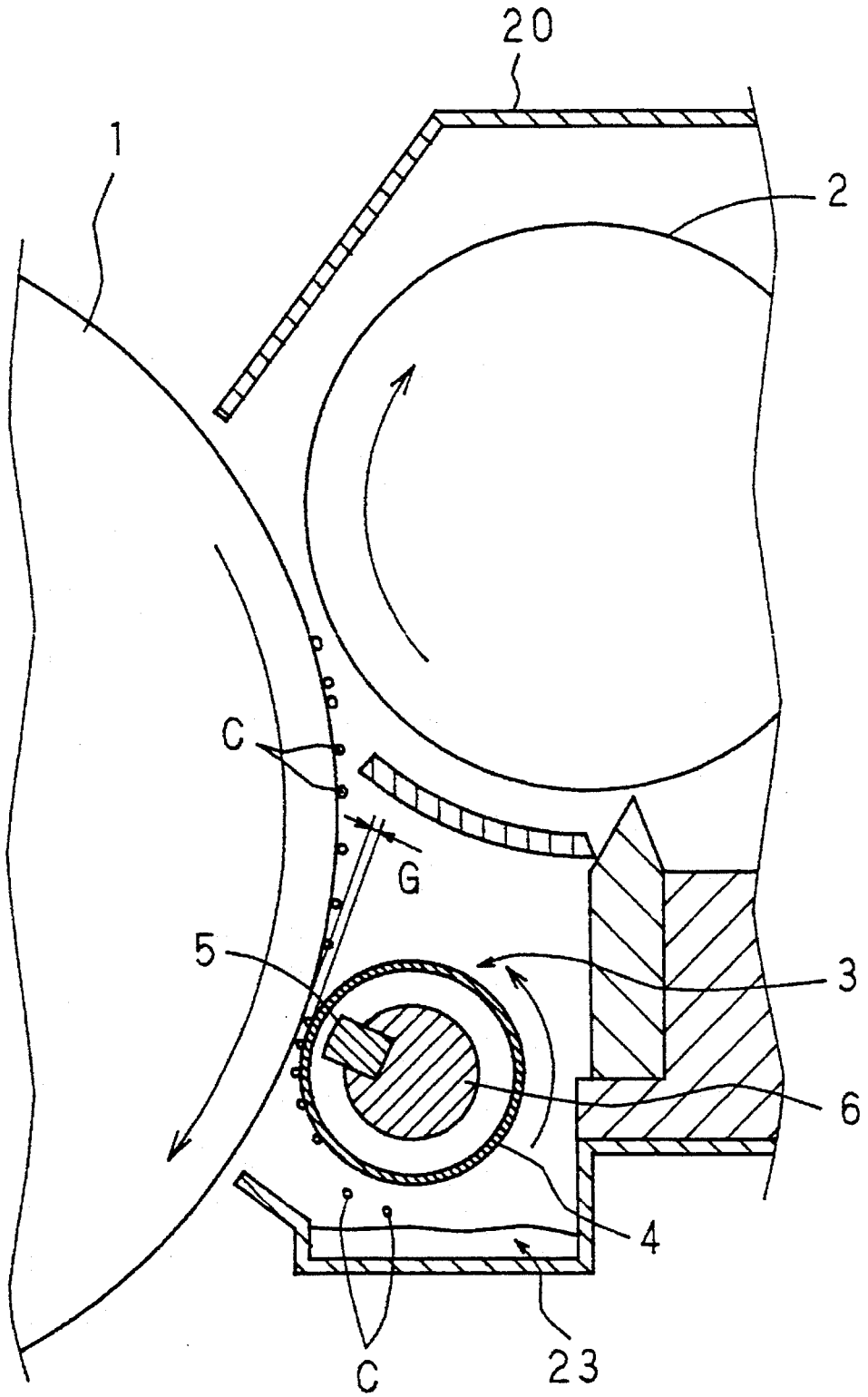
FIG. 2 is a diagram showing the main portion of a developing device of the invention.
Figure 3:
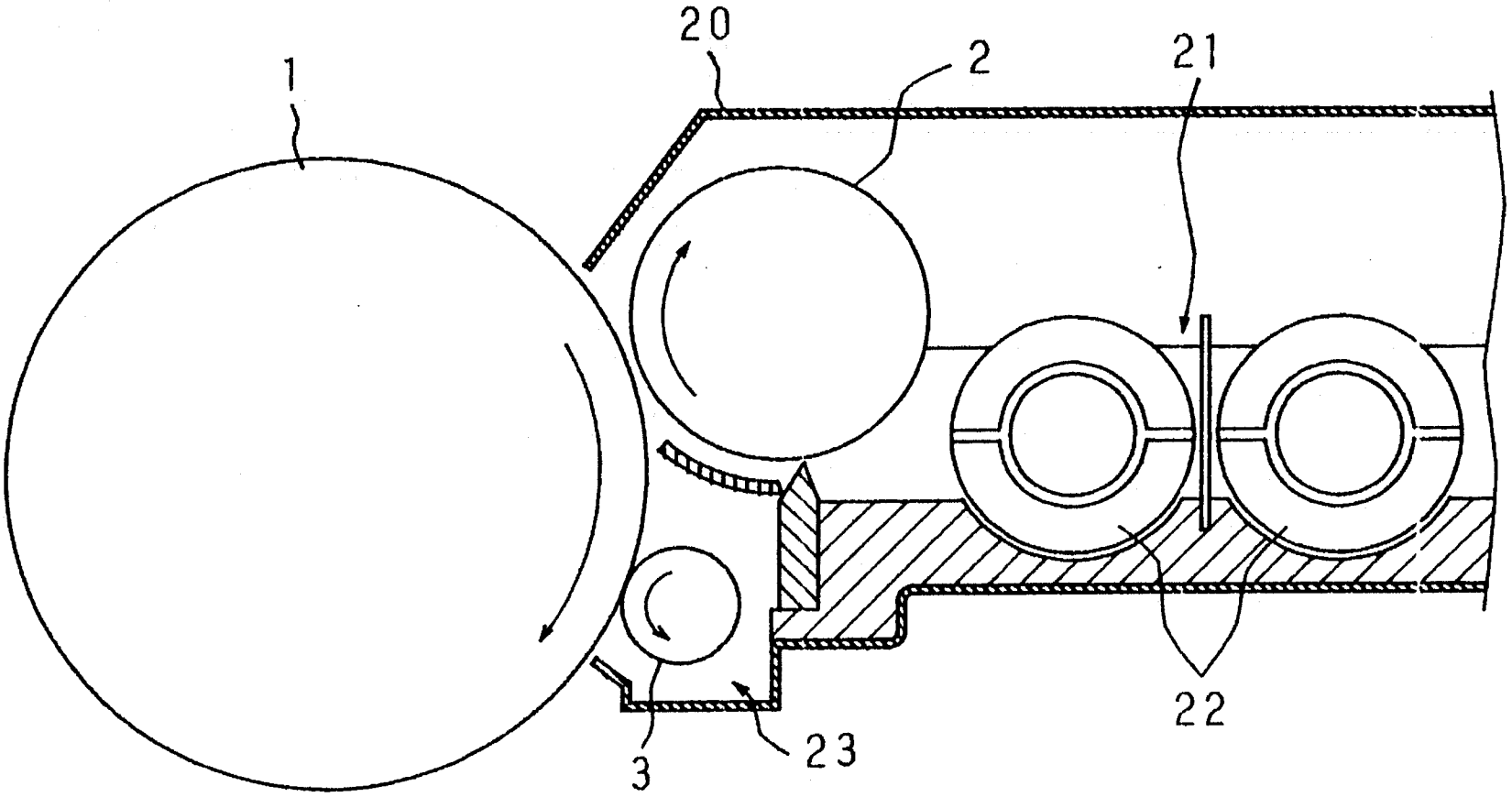
FIG. 3 is a diagram showing the developing device of the invention.

Hereinafter, the invention will be described in detail with reference to the drawings showing its embodiment. FIG. 2 is a diagram showing the main portion of a developing device of the invention, and FIG. 3 is a diagram showing the whole configuration of the developing device. As shown in FIG. 3, the developing device of the invention comprises a housing 20 which opposes a part of the peripheral face of a photosensitive drum 1 functioning as the photosensitive element. In the housing 20, a developing unit 2, and a recovery unit 3 are juxtaposed in this sequence along the rotation direction of the photosensitive drum 1.

The developing unit 2 has a known configuration in which a plurality of stationary magnets are juxtaposed along the peripheral direction of and inside an outer cylinder that is made of a non-magnetic material. The outer cylinder of the developing unit 2 is rotated by a power transmission from driving means which is not shown, about an axis parallel to the photosensitive drum 1 and in the same direction as the photosensitive drum 1. A part of the peripheral face of the outer cylinder is disposed in proximity to and opposing the surface of the photosensitive drum 1 which faces the interior of the housing 20. A storage unit 21 of a developer is disposed inside the housing 20. The other part of the peripheral face of the outer cylinder of the developing unit 2 opposes the storage unit 21. The developer stored in the storage unit 21 is a two-component developer in which a toner is mixed by stirring screws 22 disposed inside the storage unit 21, with carriers C (see FIG. 2) consisting of magnetic particles so that a large number of toner particles are held on the periphery of each carrier C. The developer is stuck to the outer cylinder of the developing unit 2 by the magnetic force of the stationary magnets, and is then transported along the peripheral direction as the developing unit 2 is rotated, by the function of a magnetic field which is generated by the plurality of stationary magnets. The toner in the developer is attracted to adhere to an electrostatic latent image formed on the surface of the photosensitive drum 1, at the position where the developing unit opposes the photosensitive drum 1, thereby developing the latent image. At this time, the carriers C which are made of a magnetic material are caused to remain on the developing unit 2 by the function of the magnetic field, and further transported together with a part of the toner. The transported carriers separate from the developing unit in an area where is not affected by the magnetic field and is formed in a part of the peripheral direction. The carriers are then recovered in the storage unit 21 and mixed with a fresh toner to be regenerated as a developer.

In the above-mentioned operation of the developing unit 2, there may arise an occasion that a part of the carriers C for transporting the toner are separated from the developing unit 2 by a centrifugal force due to the rotation of the outer cylinder, or by the attraction of the toner to the photosensitive drum 1, and a part of the separated carriers C adhere to the surface of the photosensitive drum 1. A recovery unit 3 is juxtaposed downstream of the developing unit 2 along the rotation direction of the photosensitive drum 1, and recovers the carriers C adhering to the surface of the photosensitive drum 1 by the function of the magnetic force. The invention is characterized in the configuration of the recovery unit 3.

As shown in FIG. 2, the recovery unit 3 comprises a recovery magnet 5 which is stationarily disposed inside an outer cylinder 4 made of a non-magnetic material. The outer cylinder 4 rotates in the opposite direction about an axis parallel to the photosensitive drum 1. The outer cylinder 4 is disposed at a position where the photosensitive drum 1 is seen in an obliquely upward direction, in such a manner that the peripheral face of the outer cylinder 4 is located in proximity to the surface of the photosensitive drum 1 so as to oppose the surface. A part of the housing 20 of the developing device elongates under the position where the peripheral face is located to constitute a recovery portion 23.

The recovery magnet 5 is attached to an iron core 6 which is disposed in the axial portion of the outer cylinder 4, in such a manner that one magnetic pole (e.g., N-pole) which is directed obliquely upward faces the position where the recovery unit opposes the photosensitive drum 1, and the other magnetic pole (e.g., S-pole) is embedded in the core. According to this configuration, the magnetic field in the side of the S-pole of the recovery magnet 5 is obstructed by the iron core 6 which is made of a magnetic material, and therefore only the magnetic field due to the N-pole is formed in the vicinity of the portion where the surface of the outer cylinder 4 opposes the photosensitive drum 1.

Figure 4:
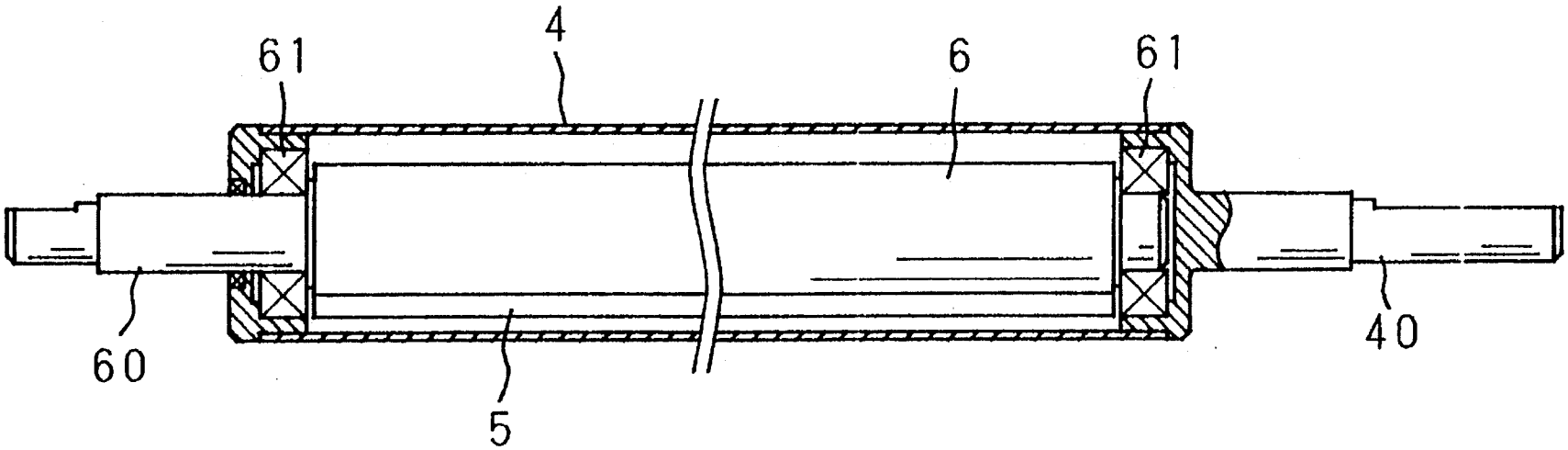
FIG. 4 is a section view of a recovery unit along the axial direction.

FIG. 4 is a section view of the recovery unit 3 along the axial direction. The iron core 6 elongates inside the outer cylinder 4 and over the whole length of the cylinder, and rotatably supports the outer cylinder 4 through bearings 61 which are respectively fitted onto both longitudinal ends. The recovery unit 3 is supported by an elongated portion 40 which elongates toward one side of the outer cylinder 4, and also by an elongated portion 60 of the iron core 6 which projects toward the other side, so that only the outer cylinder 4 is rotated by transmitting a power from driving means which is not shown, to the elongated portion 40.

Figure 5:
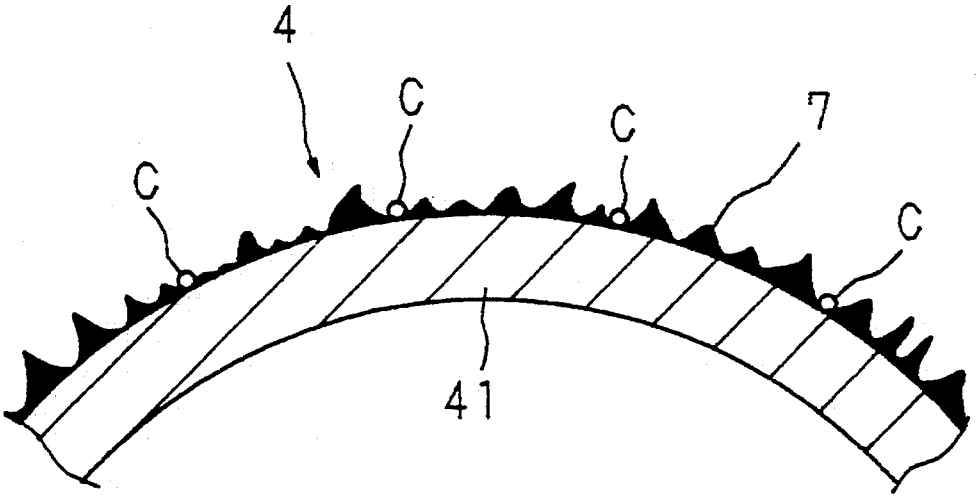
FIG. 5 is an enlarged section view of an outer cylinder of the recovery unit.

FIG. 5 is an enlarged section view of a part of the outer cylinder 4. As shown in the figure, the outer cylinder 4 is configured so that a rugged face 7 is artificially formed on the substantially whole area of the outer surface of a plain pipe 41 which is made of a nonmagnetic material such as aluminum. The rugged face 7 can easily be obtained by, for example, the so-called "METOKOROI treatment" in which sand blasting is conducted on the outer surface of the plain pipe 41 made of aluminum, fine particles of stainless steel in a molten state are continuously sprayed on the surface, and the surface of the plain pipe 41 is thereafter cooled so that the stainless steel particles are fixed to the surface. The sand blasting conducted on the surface of the plain pipe 41 is required for enhancing the fixing property of the stainless steel particles after the cooling.

In the thus configured recovery unit 3, the recovery of the carriers C is conducted in the following manner. As shown in FIG. 2, the carriers C which have separated from the developing unit 2 and adhered to the surface of the photosensitive drum 1 are caused to reach the position of the recovery unit 3 by the rotation of the photosensitive drum 1, and attracted by the magnetic force of the recovery magnet 5 which is directed to the portion opposing the photosensitive drum 1, to be stuck to the outer cylinder 4. Since the rugged face 7 is formed over the whole surface of the outer peripheral face of the outer cylinder 4, the carriers C stuck to the outer cylinder 4 are caught in recesses of the rugged face 7.

On the other hand, the outer cylinder 4 rotates in the direction indicated by an arrow in the figure. As the outer cylinder 4 rotates, the carriers C are transported downward along the peripheral direction against the magnetic force of the recovery magnet 5, while remaining to be caught on the rugged face 7. When the carriers C reach a predetermined rotation position, they are caused to drop by gravity and recovered in the recovery portion 23 which is disposed under the recovery unit 3.

In other words, the rugged face 7 formed on the outer surface of the outer cylinder 4 functions as the transport means for transporting along the peripheral direction the carriers C caught on the outer cylinder 4 by the magnetic force of the recovery magnet 5. In order to surely conduct the transportation, it is required to set the degree of the rugged face 7, i.e., the surface roughness of the outer cylinder 4 in accordance with the size of the carriers C which are to be recovered, so that the carriers C are surely arrested in recesses of the rugged face 7. When the above-mentioned "METOKOROI treatment" is employed, the degree of the rugged face 7 can suitably be set in accordance with the treatment conditions such as the size of the stainless steel particles to be sprayed, and the spraying temperature. In the case where the carriers C have a usual size, the surface roughness $R_z$ of the outer cylinder 4 may be set to be 60 to 80 μm.

The method of forming the rugged face 7 functioning as the transport means is not restricted to the above-mentioned "METOKOROI treatment", and another surface treatment method may be employed. Alternatively, a number of grooves elongating along the axial direction of the outer cylinder 4 may be formed by machining, and these grooves may be used as the transport means. However, many working steps are necessary for forming such grooves. Consequently, it is preferable to employ the rugged face 7 which is formed by a surface treatment, such as the above-mentioned "METOKOROI treatment", as the transport means.

Figure 1:
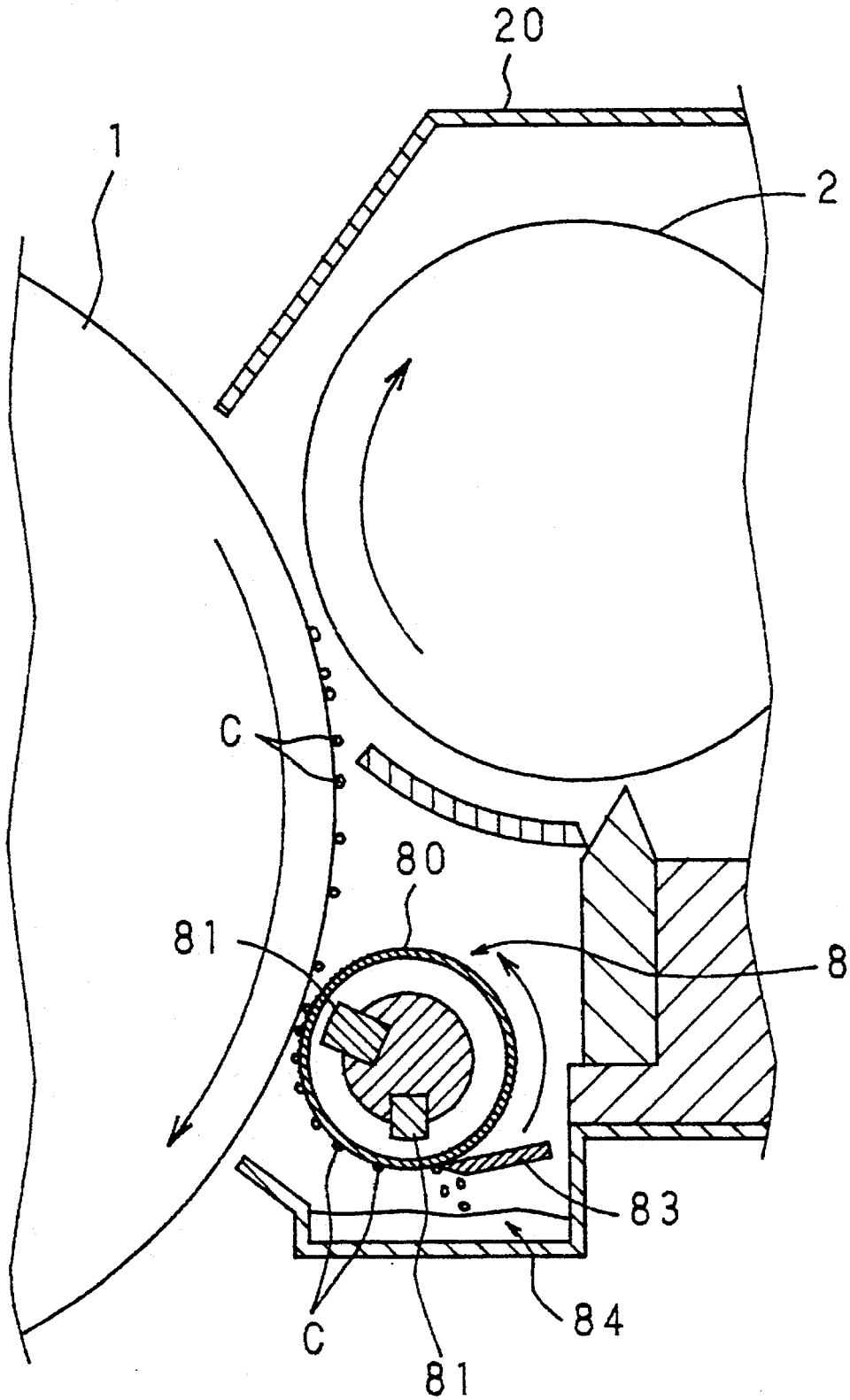
FIG. 1 PRIOR ART
FIG. 1 is a diagram showing the main portion of a developing device of the prior art.
Figure 6:
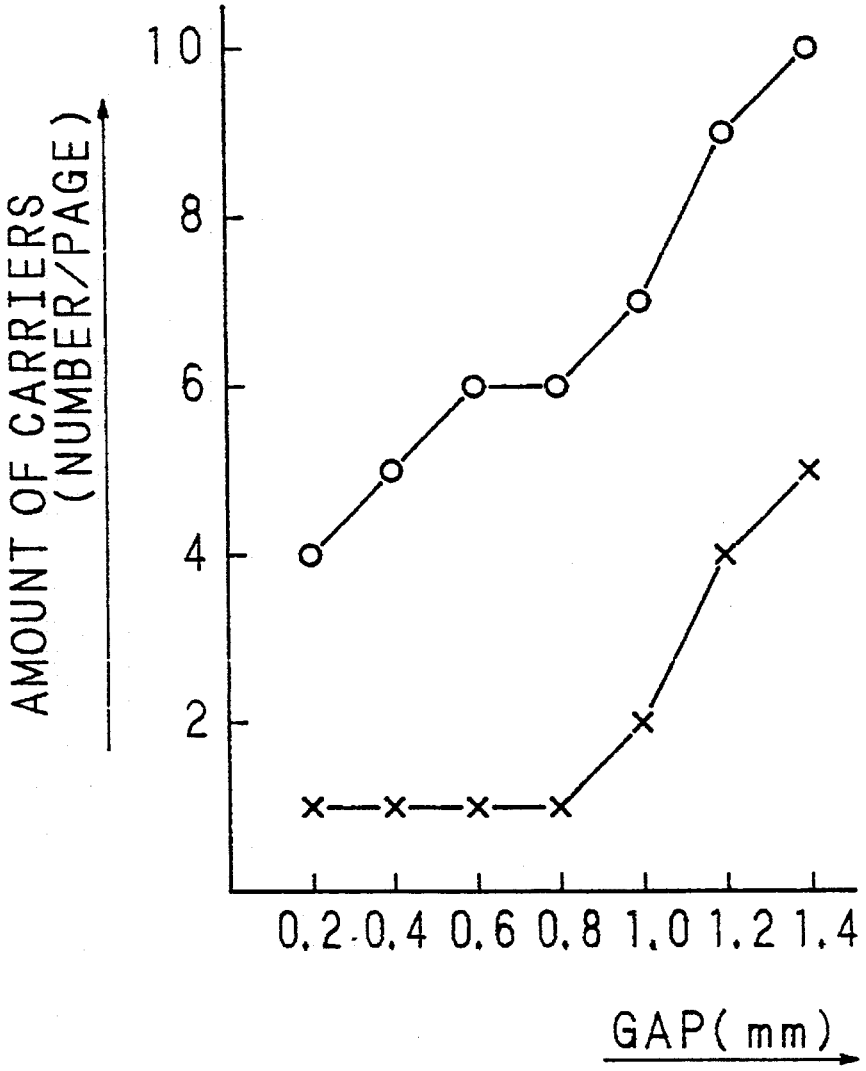
FIG. 6 is a graph showing a comparison between carrier recovery abilities.

FIG. 6 is a graph showing results which were obtained when the carrier recovery ability of the thus configured recovery unit 3 is compared with that of the conventional recovery unit 8 shown in FIG. 1. The abscissa of the graph indicates the gap G between the surface of the photosensitive drum 1 and the outer cylinder 4 or 80 (see FIG. 2), and the ordinate indicates the amount of carriers (number/page) which have not been recovered and scatter on a transfer sheet. In the graph, mark X indicates the case where the recovery unit 3 is provided, and mark ○ indicates the case where the conventional recovery unit 8 is provided. When comparing with the both cases, it is apparent that, in the case where the recovery unit 3 is provided, the amount of carriers on a transfer sheet is generally smaller and the recovery is conducted in a satisfactory manner.

From the figure, it is also known that the amount of carriers on a transfer sheet increases or the carrier recovery amount is decreased as the gap G is enlarged. This is caused by the phenomenon that the magnetic force of the recovery magnet 5 which appears on the surface of the photosensitive drum 1 and which attracts the carriers C is decreased as the gap G is enlarged. In order to obtain a satisfactory recovery state, the gap G between the surface of the photosensitive drum 1 and the outer peripheral face of the outer cylinder 4 must be set in accordance with the magnetic force of the recovery magnet 5.

Figure 7:
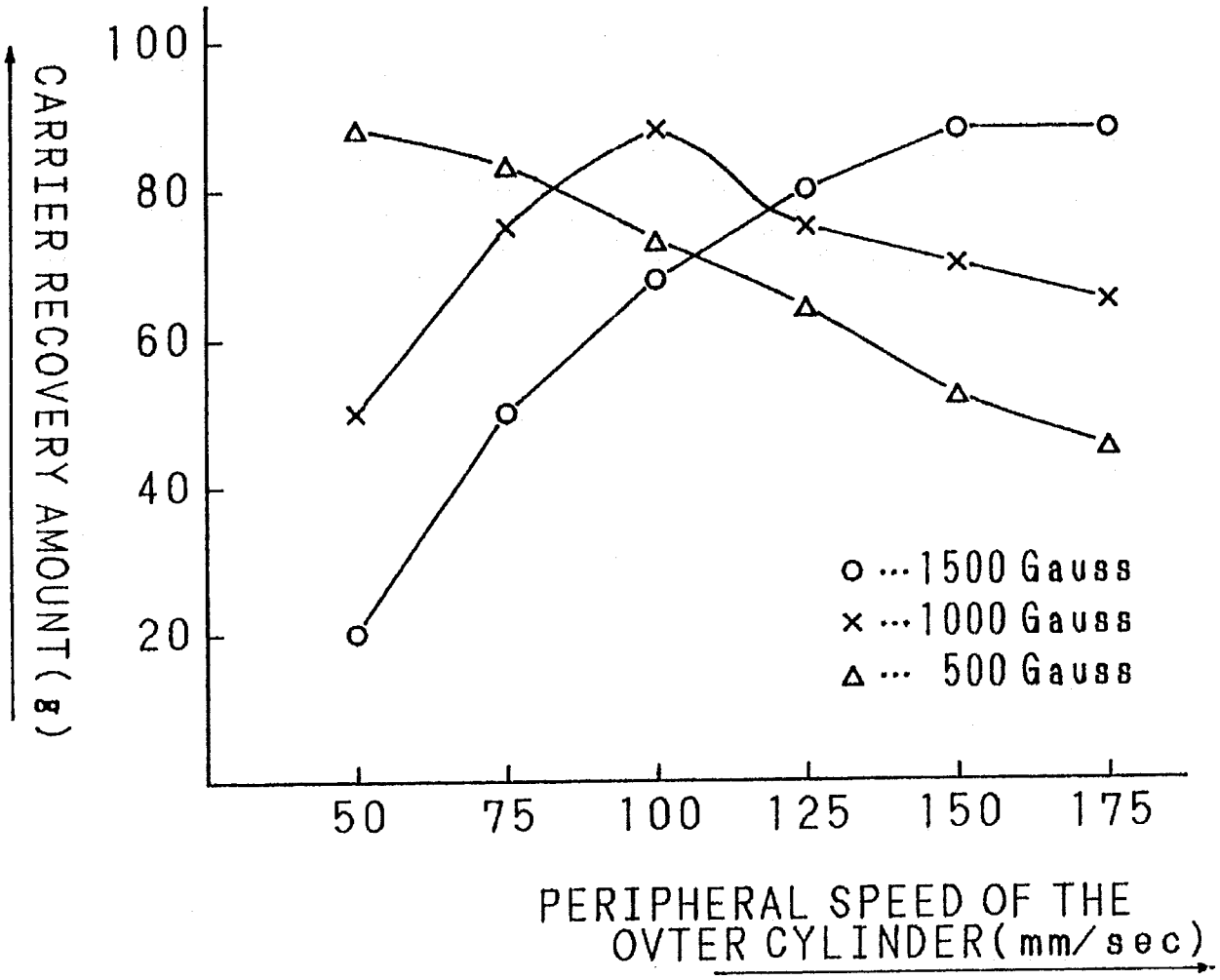
FIG. 7 is a graph showing relationships among the peripheral speed of the outer cylinder, the magnetic force of a recovery magnet, and the carrier recovery amount.

FIG. 7 is a graph showing results which were obtained in an investigation of relationships among the peripheral speed of the outer cylinder 4, the magnetic force of the recovery magnet 5, and the carrier recovery amount. The abscissa of the graph indicates the peripheral speed of the outer cylinder 4, and the ordinate indicates the carrier recovery amount in the recovery portion 23 which is expressed as grams per a unit time (20 hours). In the graph, marks ○, X, and Δ indicate carrier recovery amounts obtained when the magnetic force of the recovery magnet 5 is set to be 1,500 gauss, 1,000 gauss, and 500 gauss, respectively. As apparent from the figure, in order to obtain a larger carrier recovery amount, it is required to adequately set the relationship between the peripheral speed of the outer cylinder 4 and the magnetic force of the recovery magnet 5.

This can be described as follows: The carriers C caught on the rugged face 7 of the surface of the outer cylinder 4 are transported by the rotation of the outer cylinder 4 against the magnetic force of the recovery magnet 5. In the case where the magnetic force of the recovery magnet 5 is relatively large as compared with the peripheral speed of the outer cylinder 4 (corresponding to the left half of the line indicated by mark ○ in the graph), therefore, the carriers C remain at the position where they are attracted by the recovery magnet 5, so that the separation of the carriers is not satisfactorily conducted. By contrast, in the case where the magnetic force of the recovery magnet 5 is relatively small as compared with the peripheral speed of the outer cylinder 4 (corresponding to the right half of the line indicated by mark Δ in the graph), the transported carrier C drop before they reach the lowest position and fail to be recovered in the recovery portion 23.

In other words, when the magnetic force of the recovery magnet 5 is set depending on the peripheral speed of the outer cylinder 4 in accordance with the relationships shown in FIG. 7, it is ensured to obtain a satisfactory recovery state. When the peripheral speed of the outer cylinder 4 is 100 mm/sec, for example, the optimum magnetic force of the recovery magnet 5 is 1,000 gauss. FIG. 7 shows results which were obtained in the case where the surface roughness $R_z$ of the outer cylinder 4 is 80 μm and the gap G between the surface of the photosensitive drum 1 and the outer peripheral face of the outer cylinder 4 is 1 min. When these are set to have other values, also the relationship between the peripheral speed of the outer cylinder 4 and the magnetic force of the recovery magnet 5 is changed.

Figure 8:
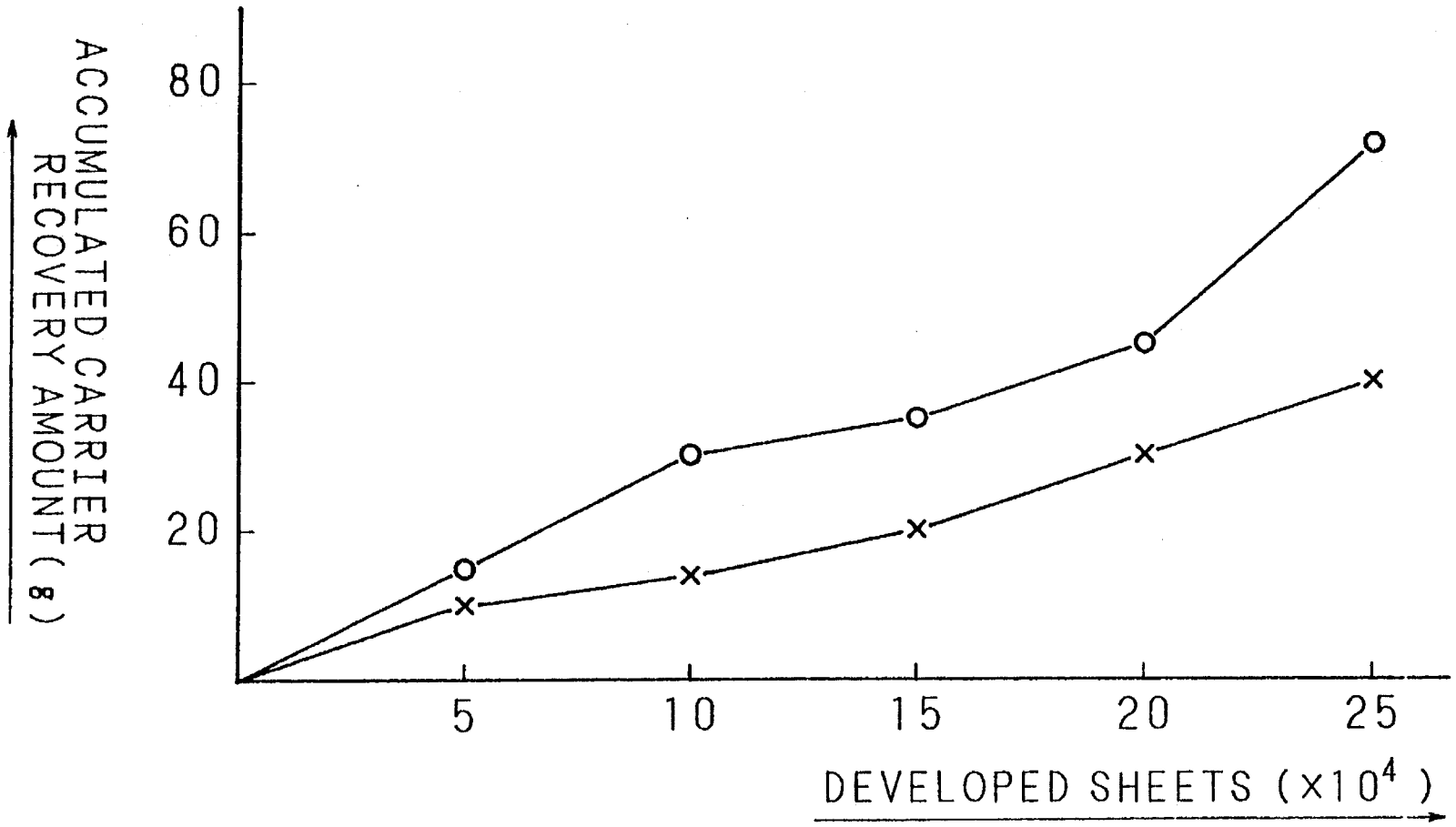
FIG. 8 is a graph showing a comparison between accumulated values of the carrier recovery amount.

FIG. 8 is a graph showing a comparison between accumulated values of the carrier recovery amount. The abscissa of the graph indicates the developed sheets, and the ordinate indicates the accumulated carrier recovery amount (g). In the same manner as FIG. 6, mark X indicates the case where the recovery unit 3 is provided, and mark o indicates the case where the conventional recovery unit 8 is provided. From the figure, it is apparent that the carriers C are effectively recovered in the developing device of the invention.

As described in detail above, in the developing device of the invention, a recovery unit for recovering carriers which are made of a magnetic material and adhere to the surface of a photosensitive element as a result of the development process has a configuration in which a recovery magnet is disposed inside an outer cylinder in proximity to and opposing the surface of the photosensitive element, while directing its one magnetic pole to the side opposing the photosensitive element, and the carriers which are caused to be stuck to the outer cylinder by the magnetic force of the recovery magnet are transported along the peripheral direction in accordance with the rotation of the outer cylinder. Consequently, the recovery unit can be reduced in size, stably hold carriers without a possibility of dropping the carriers, and surely transport the carriers to a predetermined recovery position, thereby effectively eliminating the drawbacks due to the adhesion of carriers to the photosensitive element.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A developing device, comprising:

a developing unit which is in proximity to and opposes a surface of a photosensitive element, and which develops an electrostatic latent image formed on the surface of said photosensitive element using a developer containing carriers which is made of a magnetic material; and a recovery unit which is in proximity to and opposes the surface of said photosensitive element, which is juxtaposed with said developing unit along a transportation direction of said photosensitive element, and which recovers carriers which adhere to the surface of said photosensitive element as a result of a development conducted by said developing unit, wherein said recovery unit includes:

an outer cylinder which is made of non-magnetic material, and which rotates about an axis which is substantially parallel to the surface of said photosensitive element;

a recovery magnet which is fixed inside said outer cylinder, one magnetic pole thereof being directed to the side opposing said photosensitive element;

means for obstructing a magnetic field generated by the other magnetic pole of said recovery magnet; and transport means for transporting carriers caught on the outer peripheral face of said outer cylinder by a magnetic force of said one magnetic pole, along a peripheral direction in accordance with the rotation of said outer cylinder, wherein said transport means is a rugged face with particles sprayed on an entire peripheral face of said outer cylinder, and wherein characteristics of said particles sprayed on said peripheral face of said outer cylinder are dependent on the sizes of said carriers to be caught thereon.

2. A developing device according to claim 1, wherein said rugged face of said outer cylinder has a surface roughness ($R_z$) of between 60 and 80 μm.

3. A developing device according to claim 1, wherein said outer cylinder is disposed at a position where said outer cylinder opposes the surface of said photosensitive element in an obliquely upward direction, and the rotation direction of said outer cylinder is set to be a direction in which the transport of carriers conducted by said transport means is directed downward.

4. A developing device according to claim 1, wherein the direction of the magnetic force of said recovery magnet substantially coincides with a direction which perpendicularly passes through the surface of said photosensitive element.

5. A developing device according to claim 1, wherein the magnetic force of said recovery magnet is set in accordance with a peripheral speed of said outer cylinder.

6. A developing device according to claim 5, wherein said outer cylinder is disposed at a position where said outer cylinder opposes the surface of said photosensitive element in an obliquely upward direction, and the rotation direction of said outer cylinder is set to be a direction in which the transport of carriers conducted by said transport means is directed downward.

7. A developing device according to claim 1, wherein a gap between the outer peripheral face of said outer cylinder and the surface of said photosensitive element is set in accordance with the magnetic force of said recovery magnet.

8. A developing device according to claim 7, wherein the magnetic force of said recovery magnet is set in accordance with a peripheral speed of said outer cylinder.

9. A developing device according to claim 7, wherein the direction of the magnetic force of said recovery magnet substantially coincides with a direction which perpendicularly passes through the surface of said photosensitive element.

10. A developing device according to claim 7, wherein said outer cylinder is disposed at a position where said outer cylinder opposes the surface of said photosensitive element in an obliquely upward direction, and the rotation direction of said outer cylinder is set to be a direction in which the transport of carriers conducted by said transport means is directed downward.

11. A developing device according to claim 1, wherein said transport means is a rugged face which is formed by a surface treatment in a substantially whole area of the outer peripheral face of said outer cylinder.

12. A developing device according to claim 11, wherein said outer cylinder is disposed at a position where said outer cylinder opposes the surface of said photosensitive element in an obliquely upward direction, and the rotation direction of said outer cylinder is set to be a direction in which the transport of carriers conducted by said transport means is directed downward.

13. A developing device according to claim 11, wherein the direction of the magnetic force of said recovery magnet substantially coincides with a direction which perpendicularly passes through the surface of said photosensitive element.

14. A developing device according to claim 11, wherein the magnetic force of said recovery magnet is set in accordance with a peripheral speed of said outer cylinder.

15. A developing device according to claim 11, wherein a gap between the outer peripheral face of said outer cylinder and the surface of said photosensitive element is set in accordance with the magnetic force of said recovery magnet.

16. A developing device according to claim 15, wherein the direction of the magnetic force of said recovery magnet substantially coincides with a direction which perpendicularly passes through the surface of said photosensitive element.

17. A developing device according to claim 15, wherein said outer cylinder is disposed at a position where said outer cylinder opposes the surface of said photosensitive element in an obliquely upward direction, and the rotation direction of said outer cylinder is set to be a direction in which the transport of carriers conducted by said transport means is directed downward.

* * * * *